United States Patent [19]

Zaveri

[11] 4,270,082

[45] May 26, 1981

[54] OPEN-CIRCUIT SHUNT-REGULATED HIGH-VOLTAGE CIRCUIT

[75] Inventor: Pradhumankumar S. Zaveri, Fort Wayne, Ind.

[73] Assignee: General Electric Company, Fort Wayne, Ind.

[21] Appl. No.: 60,196

[22] Filed: Jul. 24, 1979

[51] Int. Cl.[3] ..... G05F 1/64

[52] U.S. Cl. ..... 323/248; 323/254; 363/75; 363/90

[58] Field of Search ..... 323/6, 8, 56, 60, 61, 323/80, 81, 86; 363/75, 82, 90, 91, 60, 61

[56] References Cited

U.S. PATENT DOCUMENTS

| | | | |
|---|---|---|---|
| 3,525,035 | 8/1970 | Kakalec | 363/75 X |
| 3,815,015 | 6/1974 | Swin et al. | 323/8 X |
| 3,914,685 | 10/1975 | Van Gilder | 323/61 X |
| 4,001,665 | 1/1977 | Wisner et al. | 323/60 X |
| 4,030,025 | 6/1977 | Kakalec | 363/75 X |

*Primary Examiner*—William M. Shoop
*Assistant Examiner*—Peter S. Wong
*Attorney, Agent, or Firm*—Arthur E. Bahr; James H. Beusse

[57] ABSTRACT

Shunt regulation for a high-voltage circuit including a ferroresonant transformer has control circuitry associated with a low-voltage control winding on the transformer, the control winding being magnetically coupled with the high-voltage secondary winding thereof. The control circuitry includes a zener diode for clamping peak voltages on the control winding and a sub-circuit including a voltage-divider and a capacitor. An averaged voltage from the divider/capacitor is compared with a reference by a comparator. Both the comparator and the zener diode serve to turn on a transistor connected across the control winding output, thereby allowing current to flow through the control winding, dropping the output voltage thereof. Regulation of the output voltage on the transformer high-voltage secondary results.

9 Claims, 1 Drawing Figure

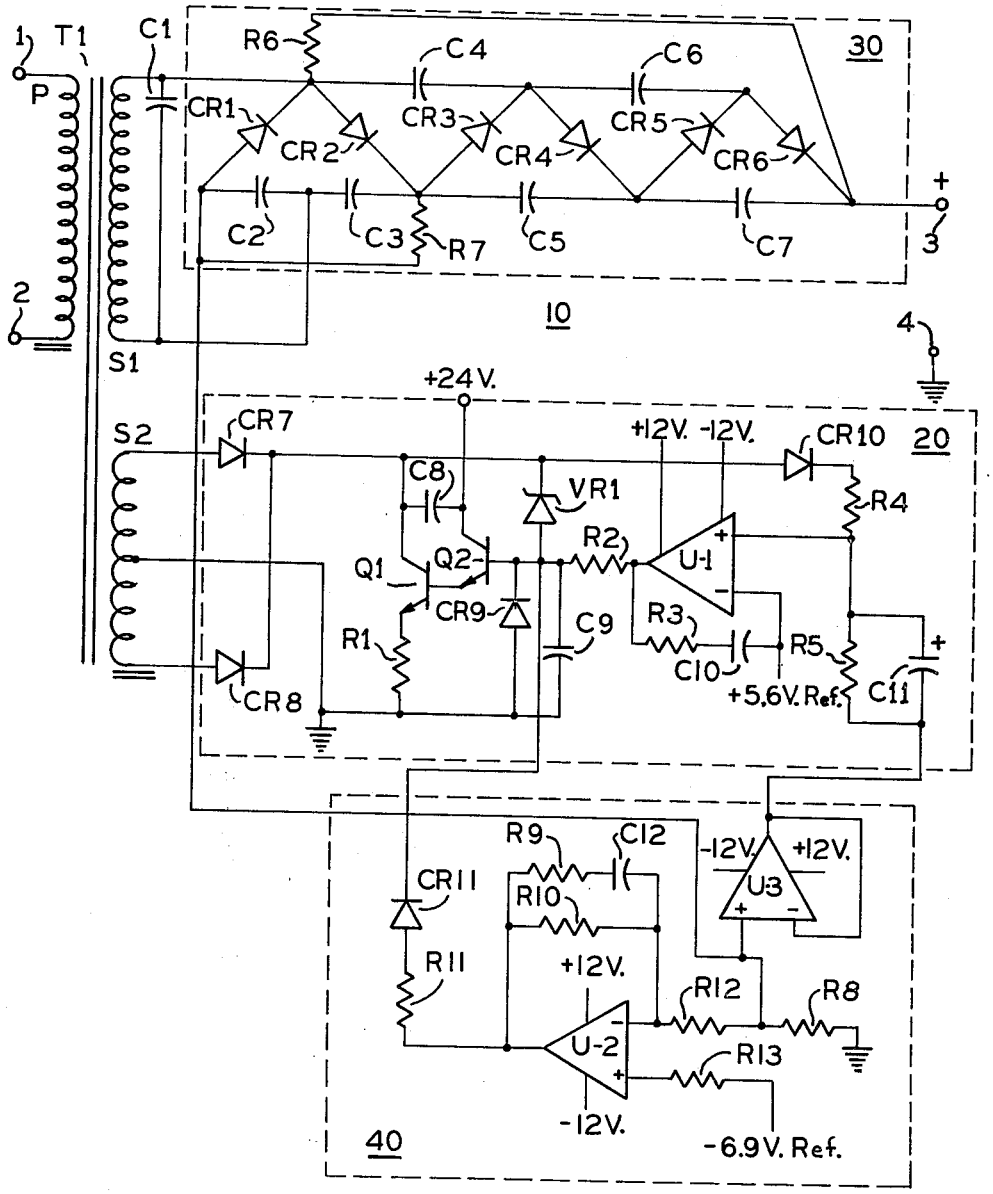
1
T1
C1
R6
C4
C6
30
P
CR1
CR2
CR3
CR4
CR5
CR6
+
C2
C3
R7
C5
C7
3
2
10
4
S1
+24V.
S2
CR7
+12V.
-12V.
CR10
20
C8
VR1
R4
R2
Q1
Q2
U-1
CR9
R3
C9
R1
C10
R5
+5.6V. Ref.
C11
CR8
R9
C12
-12V.
+12V.
CR11
R10
U-3
R11
+12V.
R12
R8
U-2
R13
-12V.
40
-6.9V. Ref.

OPEN-CIRCUIT SHUNT-REGULATED HIGH-VOLTAGE CIRCUIT

BACKGROUND OF THE INVENTION

1. Field of the Invention

The present invention relates to shunt regulation, and in particular, to an improved shunt regulating circuit associated with a low-voltage control winding on a ferroresonant transformer for regulating high-voltage output of the transformer.

2. Description of the Prior Art

A helium-neon laser typically requires 12 to 13 KV for starting. Once started, such a laser requires a constant current of approximately 6 ma at about 2200 volts for operation.

A typical power supply for operating a He-Ne laser consists of a ferroresonant transformer operated from a line frequency supply. The transformer output is fed to a voltage multiplying circuit for increasing the voltage to about 13 KV for starting the laser. The open-circuit output voltage is regulated by a standard shunt regulating circuit associated with a low-voltage control winding in the ferroresonant transformer. After starting the laser, loading of the multiplier circuit causes the output voltage to drop from 13 KV to about 2200 volts for continuing laser operation. The output voltage under load continues to be regulated by the shunt regulating circuit.

It is desirable that such a power supply operate from 50 Hz or 60 Hz and provide plus or minus 1 KV regulation with an input of plus or minus 10% of the nominal input voltage. The output of a ferroresonant transformer is a function of the line frequency of the input supply, since flux saturation of such a transformer varies inversely with frequency. Normally, for output regulation with 50 Hz and 60 Hz line frequency operation, taps are provided on the transformer primary winding or, two different transformers are used having different stack heights. Such an arrangement still will result in the output voltage varying by perhaps 25% from low-line to high-line input due to inherent characteristics of the ferroresonant transformer under no-load circumstances.

Another method to regulate an open-circuit, high-voltage output is to sense the output voltage and then feed it back to a control circuit to effect regulation. Sensing an output voltage in the range of 12 to 13 kv is not economical. Also, a feedback arrangement would load down the line frequency operated multiplier circuit when such is used to raise the high voltage output of a ferroresonant transformer, thereby lowering the multiplier output voltage, partially eliminating the main function of the multiplier.

It is desirable, therefore, to provide a means for regulating the output of a high-voltage circuit, including a ferroresonant transformer, without making use of feedback circuitry. It is further desirable that such high-voltage output be regulated typically within plus or minus 8% while the input voltage to the primary of the ferroresonant transformer varies plus or minus 10%, and indeed, on a ferroresonant transformer capable of operation from either 50 Hz or 60 Hz.

SUMMARY OF THE INVENTION

In accordance with the present invention, there is provided a high-voltage circuit with open circuit shunt regulation. Included is a ferroresonant transformer made up of a high-reactance transformer having a low voltage primary winding for connection to a source of AC electrical energy and a high-voltage secondary winding for producing a high-voltage output, and further, with a capacitance connected across the high-voltage secondary winding. A low-voltage, control, secondary winding is magnetically coupled with the high-voltage secondary winding of the high-reactance transformer. Control means are provided associated with the control secondary winding for regulating the high voltage output of the ferroresonant transformer. This control means includes: means for rectifying the output voltage produced by the control winding; means for controlling current through the control winding, said current controlling means being connected across the rectified output of the control winding thereby to regulate the output voltage thereof; means for clamping peak control winding output voltage for producing a signal to effect operation of the current controlling means; means for sampling and averaging the clamped control winding output voltage; and means for comparing the averaged sampled control winding output voltage with a reference voltage and for producing a signal to effect operation of the current controlling means when the averaged sampled output voltage is greater than the reference voltage.

BRIEF DESCRIPTION OF THE DRAWING

The accompanying drawing is a schematic representation of the preferred embodiment of the high-voltage circuit with improved open-circuit shunt regulation of the present invention.

DESCRIPTION OF THE PREFERRED EMBODIMENT

In accordance with the present invention and referring now to the drawing, there is shown the preferred embodiment of a high-voltage circuit 10 with open circuit shunt regulation. A high-reactance transformer T1 includes a primary winding P for connection to a line source of AC electrical energy, either of 50 Hz or 60 Hz. Transformer T1 also includes a high-voltage secondary winding S1 and connected across the output thereof is a capacitance C1. This combination of a high-reactance transformer and a capacitance across its output operates as a ferroresonant transformer; that is, a transformer whose output voltage remains fairly stable for a variety of input voltages. Typically, the input voltage to such a ferroresonant transformer may vary plus or minus 10% from the nominal input voltage while the output voltage thereof remains fairly stable. A low voltage, control, secondary winding S2 is provided magnetically coupled with the secondary winding S1 of the high-reactance transformer; in practice the secondary winding S2 is concentrically wound with the high-voltage secondary winding S1.

A control means 20 is provided associated with the control secondary winding S2 for controlling the output voltage of the ferroresonant transformer. Control means 20 in conjunction with the control winding S2 provides shunt regulation for the ferroresonant transformer. The low-voltage output of winding S2 is rectified by diodes CR7 and CR8.

Means are provided for controlling current through the control winding S2 and includes a transistor Q1 connected across the rectified output thereof. A resistor R1 serves to limit current through the resistor Q1.

Means are also provided for clamping peak output voltage on the control winding S2 and includes a zener diode VR1. Means are provided for sampling and averaging the clamped control winding output voltage, this including a voltage divider consisting of resistors R4 and R5, and a capacitor C11 connected in parallel with resistor R5.

In operation, rectified low-voltage from control winding S2 is fed to the transistor Q1, the zener diode VR1 and the divider network of resistors R4 and R5. As the line voltage supplied to input terminals 1 and 2 of the primary P increases from low-line to high-line, and likewise, when the frequency on the input is changed from 50 Hz to 60 Hz, under open-circuit output conditions, the voltage across the control winding S2 will increase. The zener diode VR1 will conduct, clamping the peak voltage on control winding S2 thus turning on the transistor Q1. In practice, a transistor Q2 is connected in darlington with transistor Q1. Turning on transistor Q1 will allow current to flow in the control winding S2, and because of the inherent characteristics of a ferroresonant transformer, the effect will be to clamp the high voltage output of secondary winding S1. The output therefore, will see a constant peak. However, the average output will still increase due to a change in the waveshape of the secondary voltage appearing on winding S2. The rectified, clamped voltage therefore, will now appear across resistors R4 and R5. The voltage across resistor R5, due to capacitor C11, will be averaged out. This clamped averaged voltage across R5 is compared with a fixed reference of 5.6 volts by comparing means, a comparator U1, in each half cycle. The output of the comparator U1 will be at a higher level in each cycle for a longer time as long as the input level is high. The output of comparator U1 will keep transistors Q2 and Q1 turned-on for a longer time therefore, in each half cycle. This in effect allows more current to flow through the low-voltage control winding S2 and the output voltage on the high-voltage secondary winding S1 will be suppressed even further. Such will countereffect the increase in the average output voltage due to a change in the waveshape.

Capacitors C8, C9, and C10 and resistor R3 serve as a stabilizing network. Resistor R2 serves to limit current, and diode CR9 will avoid reverse-biasing of emitter to base of transistors Q1 and Q2. Diode CR10 blocks the average voltage feedback on transistor Q1 and zener diode VR1.

In practice, that portion of the circuitry designated 40 is provided for regulating output load current. A resistor R8 senses output load current and provides a signal to operational amplifier U-2 through resistor R12. This sense signal is compared with a fixed reference of -6.9 volts fed to op amp U-2 through resistor R13. An amplified, error signal from op amp U-2 and resistor R10 is then fed through resistor R11 and diode CR11 to the base of transistor Q2. This then turns on transistor Q1. When load current as sensed by resistor R8 increases, base current to transistor Q1 increases, thereby resulting in increased collector current in Q1 and increased current flow in winding S2. There results a reduction of the output voltage across winding S1 and hence across terminals 3 and 4, thus compensating for the increase in load current, with the net effect being constant output current.

Under circuit load conditions, a negative sense signal from resistor R8 produces a negative output from voltage-follower U-3. This negative output is fed to capacitor C11 and resistor R5 and effects lowering the output of the comparator U-1 below the output of op amp U-2; U2 therefore takes over control.

Resistor R9 and capacitor C12 forming a part of 40 serve as a stabilizing network.

In order to provide high-voltage on the order of 12 to 13 kv to effect starting a laser, a multiplier circuit 30 (with bleeder resistors R6 and R7) is included connected to the output of high-voltage secondary winding S1. This multiplier serves to raise the approximately 2 kv output from secondary S1 to approximately 13 kv. Using the improved shunt regulation of the circuit of the present invention, the power supply open circuit output voltage on pins 3 and 4 is regulated to within plus or minus 1 kv. Such regulation is achieved even though the input voltage on pins 1 and 2 varies plus or minus 10%, or when the frequency of the input voltage is changed from 50 Hz to 60 Hz. Only one transformer is therefore required for both 50 and 60 Hz operation, and since the need for a feedback circuit is eliminated, loading of the multiplier circuit 30 is avoided. This is so because the control circuit 20 is completely isolated from the high-voltage circuit of secondary winding S1 and multiplier circuit 30. In addition, the circuit is economical to build.

The shunt regulated, high-voltage circuit of the present invention has been built and has operated satisfactorily with components having the following values and designations:

| | | |
|---|---|---|
| Transformer T1 | Primary winding P; 425 turns, 0.0201 dia; approx. 115 volts in | |
| | Secondary winding S1; 6540 turns, 0.004 dia; approx. 2KV out | |
| | Secondary winding S2; 300 turns, 0.0159 dia; 40V out | |
| Capacitors | C1 | 0.018 uF, 4KVAC |
| | C2,C3 | 2.0 uF, 2500VDC |
| | C4,C5,C6,C7 | 0.002 uF, 10KVDC |
| | C8 | 0.15 uF, 100VDC |
| | C9 | 0.1 uF, 100VDC |
| | C10 | 0.22 uF, 100VDC |
| | C11 | 22 uF, 16VDC |
| | C12 | 0.68 uF, 100VDC |
| Resistors | R1 | 2.5 ohm, 10W |
| | R2 | 1K ohm, ½W |
| | R3 | 220 ohm, ½W |
| | R4 | 5.6K ohm, ½W |
| | R5 | 2K ohm, ½W |
| | R6 | 1000M ohm, 3W |
| | R7 | 30M ohm, 10W |
| | R8 | 665 ohm, ½W |
| | R9 | 3.3 K ohm, ½W |
| | R10 | 150K ohm, ½W |
| | R11,R12,R13 | 1K ohm, ½W |
| Diodes | CR1,CR2,CR3, CR4,CR5,CR6 | 15ma, 10KV |
| | CR7,CR8,CR9, CR10,CR11 | IN4004 |
| Zenior Diode | VR1 | 1N 4756A |
| Transistors | Q1 | 2N 3055A |
| | Q2 | RCA 60408 |
| Comparator | U-1 | LM324 |
| Op Amp | U-2 | LM324 |
| Voltage Follower | U-3 | LM324 |

It should be apparent to those skilled in the art that the embodiment described heretofore is considered to be the presently preferred form of the invention. In accordance with the patent statutes, changes may be made in the disclosed device and the manner in which it is used without actually departing from the true spirit and scope of the invention.

What is claimed is:

1. A High-Voltage Circuit with Open Circuit Shunt Regulation comprising:

a ferroresonant transformer including a high-reactance transformer having a low voltage primary winding for connection to a source of AC electrical energy, and a high-voltage secondary winding for producing a high-voltage output; and a capacitance connected across the high-voltage secondary winding;

a low-voltage secondary control winding magnetically coupled with the high-voltage secondary winding of the high-reactance transformer; and control means associated with the secondary control winding for regulating the high-voltage output of the ferroresonant transformer, the control means including:

means for rectifying the output voltage produced by the control winding;

means for controlling current flow through the control winding, said current controlling means being connected across the rectified output of the control winding thereby to regulate the output voltage thereof;

means for clamping peak control winding output voltage for producing a signal to effect operation of the current controlling means;

means for sampling and averaging the clamped control winding output voltage; and means for comparing the averaged sampled control winding output voltage with a reference voltage and for producing a signal to effect operation of the current controlling means when the averaged sampled output voltage is greater than the reference voltage;

whereby the high-voltage output tracks the control winding output voltage.

2. The invention of claim 1 further comprising:

a voltage multiplier connected to the output of the high-voltage secondary winding for raising the output voltage thereof.

3. The invention of claim 1 wherein the current controlling means is a transistor having its collector and emitter connected across the control winding output and being responsive to an external signal to become conductive.

4. The invention of claim 3 wherein a second transistor is connected in darlington.

5. The invention of claim 3 wherein the clamping means is a zener diode having one of its terminals connected to the control winding output and the other terminal connected to the base of the transistor.

6. The invention of claim 5 wherein the means for sampling and averaging includes a voltage divider connected across the clamped output of the control winding and a capacitor connected to the voltage divider.

7. The invention of claim 6 wherein the means for comparing is a comparator which, in each half cycle, compares the averaged sampled output voltage from the control winding with a reference voltage thence to produce a signal for effecting turn-on of the transistor.

8. The invention of claim 1 further comprising:

means associated with the control means for regulating load current through the high voltage output of the ferroresonant transformer.

9. The invention of claim 8 wherein the current regulating means includes: means for sensing load current flowing in the high-voltage secondary winding to provide a signal representation of the load current; and means for comparing the signal with a reference thereby to produce an amplified error signal to effect operation of the current controlling means when load current is above a predetermined level.

* * * * *